US005509989A

United States Patent [19]

Taubl

[11] Patent Number: 5,509,989

[45] Date of Patent: Apr. 23, 1996

[54] METHOD FOR PRODUCING DECORATIVE LAMINATE FINISHES

[76] Inventor: Clayton Taubl, P.O. Box 1869, Orange Park, Fla. 32067-1869

[21] Appl. No.: 108,247

[22] Filed: Aug. 19, 1993

[51] Int. Cl.[6] ..... B44C 1/16

[52] U.S. Cl. ..... 156/238; 156/230; 156/231; 156/247; 156/235; 156/240; 156/249; 118/402; 427/274; 427/267; 427/262; 427/263; 427/268; 427/281

[58] Field of Search ..... 427/274, 267, 427/268, 262, 263, 281, 271, 274; 156/230, 231, 247, 235, 238, 240, 249, 241, 246; 118/402

[56] References Cited

U.S. PATENT DOCUMENTS

| | | | |
|---|---|---|---|
| 855,474 | 6/1907 | Newberry | 118/402 |
| 1,923,909 | 8/1933 | Brown | 118/402 |
| 1,931,667 | 10/1933 | Loetscher | 427/268 X |
| 2,118,781 | 5/1938 | Sallada | 427/280 X |
| 2,140,498 | 12/1938 | Dreyer | 427/434.5 X |
| 2,981,632 | 4/1961 | Bennett | 427/280 X |
| 3,551,244 | 12/1970 | Forester et al. | 264/298 |
| 3,657,304 | 4/1972 | Fukushima | 156/77 X |
| 3,933,561 | 1/1976 | Larson | 156/246 |
| 4,010,057 | 3/1977 | Nakanisha | 156/230 X |
| 4,229,239 | 10/1980 | Arai | 156/235 X |
| 4,289,821 | 9/1981 | Gray | 156/247 X |
| 4,378,387 | 3/0983 | Mitchell | 427/263 X |
| 4,490,413 | 12/1984 | Stimson | 427/262 X |
| 4,946,715 | 8/1990 | Avera | 427/273 |
| 5,084,303 | 1/1992 | Avera | 427/263 |
| 5,122,395 | 6/1992 | Sandor | 427/262 X |
| 5,169,686 | 12/1992 | McKinnon | 427/263 X |
| 5,304,272 | 4/1994 | Rohrbacker | 156/209 X |

*Primary Examiner*—David A. Simmons
*Assistant Examiner*—Steven J. Helmer

[57] ABSTRACT

A method for the production of a decorative laminate finish is disclosed. A relatively minor amount of lacquer colorant is applied to the surface of an aqueous bath. After partially drying the colorant to a flexible film, a substrate is contacted with the film and the resulting laminate is separated from the bath.

12 Claims, No Drawings

METHOD FOR PRODUCING DECORATIVE LAMINATE FINISHES

BACKGROUND OF THE INVENTION

1. Field of the Invention

This invention relates broadly to a method for decorating a substrate such as a wood plank or molding. This application relates more specifically to methods and compositions for the production of faux finishes, e.g., faux marbleized finishes on a substrate.

2. Description of the Prior Art

The creation of imitation marble, granite and like decorative finishes has been practiced for centuries, primarily as an artistic endeavor wherein an artisan manually applies paint to a surface and manipulates it into a pattern that seeks to duplicate the appearance of natural marble, granite, etc. In order to make such operations less labor intensive, a variety of techniques have been tried to get paints or colorants, when applied to a substrate, to assume a marbleized design without need for detailed manipulation thereof by the artisan.

One early procedure was to mix the colorant with fermented liquor, apply it to a primed surface and, while still wet, sprinkle it with a hot solution of alkali (see U.S. Pat. No. 242,728).

Another marbleizing process involved throwing a series of colors onto a surface with a brush, sponge, or the like and then applying a thin coating of white lead, terebene and turpentine to intensify the colors (see U.S. Pat. No. 654,404).

In another process, imitation marble was alleged to result from mixing oil color with a volatile liquid, e.g., benzin or ether and a drier, applying this glazing color to a surface and then topping the wet coating with turpentine to distribute the color into a marbled design (see U.S. Pat. No. 825,213).

In an automatic method for producing a faux finish, a continuous strip of metal channel is coated with oil-based paint. The coating is spattered with a non-uniform coating of solvent for the paint and mechanically induced to flow on the coated surface (see U.S. Pat. No. 4,946,715).

In yet another method, portions of a substrate surface are coated with aqueous mixtures of colorant. A water-insoluble volatile organic liquid dissolved in a water-miscible alcohol is then applied. The solution acts on the coated colorant to produce a faux finish (see U.S. Pat. No. 5,122,395).

Each of these approaches has exhibited substantial drawbacks and/or limitations.

OBJECTS

A principal object of the invention is the provision of new methods and compositions for the production of decorative finishes.

A further object is the provision of-methods that produce high quality faux finishes without need for extensive artisan manipulation of colorants on the substrate and/or unique finishing compositions.

A still further object of this invention is the provision of a method in which there is minimal need to treat the finish after application to a substrate.

Other objects and applicability of the present invention will become apparent from the detailed descriptions given herein. It should be understood, however, that these descriptions, while indicating preferred embodiments of the invention, are given by way of illustration only. Various changes and modifications within the spirit and scope of the invention will become apparent from such descriptions.

SUMMARY OF THE INVENTION

The objects of the present invention are accomplished by a series of steps. First, an aqueous bath is provided. A minor amount of a lacquer colorant is then applied to the surface of the bath. This is partially dried to produce a flexible film. The substrate and the film are contacted and the resulting laminate is separated from the aqueous bath.

In a preferred embodiment, the substrate utilized to separate the colorant film is a flexible carrier sheet such as a plastic film. This results in a temporary laminate which may be employed as a intermediate for production of the final laminate. The film on the temporary laminate is contacted with a second, permanent substrate such as a wood plank or molding. This allows transfer of the colorant film to the second substrate. After releasing or peeling off the flexible sheet and drying of the film substrate is completed, the final or permanent laminate is formed.

DETAILED DESCRIPTION OF THE INVENTION

The aqueous baths utilized in accordance with the present invention are well known in the art. Commonly, they comprise a tray or trough of suitable dimensions (compared to the substrate to be employed) and filled with an aqueous medium.

The bath can simply be used and reused in a batch-type procedure. For certain applications, however, it is desirable to produce film continuously. This permits the decoration of substantial areas or lengths. For such an application, the bath medium should be caused to pass or flow through the trough, continuously presenting a new surface upon which the present colorant can be applied. Simultaneously, the film is separated from a distant, downstream area of its surface.

The aqueous medium may simply be water. To ensure that the colorant film will be readily transferable, this medium frequently contains a viscosity enhancer. Thus starch, carrageen-moss or other known sizing agents may be incorporated into the bath medium in an amount which facilitates processing.

The colorant applied to the surface of the bath may be any lacquer. Lacquers are conventional compositions containing binder, pigment and a volatile liquid carrier. The binder is a high molecular weight acrylic and/or vinyl polymer. Commonly, at least the majority of this binder is a poly(methylmethacrylate). The carrier may be either a solvent or dispersant which normally contains a predominant amount of ester, aromatic hydrocarbon and/or petroleum thinner. In either case, the lacquer dries by evaporation of the carrier.

The liquid lacquer may simply be poured onto the bath. However, a preferred technique of application involves the use of commercial lacquer sprays. The paint can be sprayed over the bath surface to ensure a relatively uniform and complete film coating. By using several spray cans containing different colorants, a particularly preferred effect is obtained. The resulting films and/or laminates display areas of sharply divergent color characterized by smooth transitions at their adjoining edges.

At least sufficient colorant to form a continuous film over the bath surface is preferred. This ensures against uneven adherence to the substrate. In general, an amount closer to the minimum is preferred to facilitate handling.

After the film has been applied to the bath surface, it can be mechanically patterned to enhance its appearance. For example, a wooden rod or comb consisting of an array of teeth can be used to mechanically overlay the colorant in the film. The tool is inserted into or through the film and then moved to form the desired pattern. By control over the length and direction of movement, various patterns which are wave-like, vein-like, swirl-like or even floral may be imparted. These patterns can be localized or continuous and variant or homogeneous, depending upon the desired effect.

In another preferred embodiment, patterning can be effected by spraying a solvent onto the film surface. By introducing dispersed droplets of an organic solvent such as acetone, spots develop in the colorant film. These can be retained or, by further mechanical agitation as already discussed, transformed into particularly desirable patterns.

Either or both of these preferred patterning steps are readily understood and perfected through brief trial. After simple experimentation, the operator can achieve and repeat virtually any effect desired.

After the colorant has been applied to the bath surface (and optionally patterned) it is dried until a flexible film is produced. This film will adhere to the substrate on contact. For some colorants, this condition is achieved almost immediately. For other, slower drying colorants, a considerable amount of time may be required.

The amount of drying time may be controlled by means well known in, for example, the paint art. Accelerants or, more commonly, retardants such as acetone or another organic solvent may be added to the colorant before or after it is applied to the bath surface. When added prior to the colorant they have the additional benefits of reducing the formation of bubbles and enhancing patterning.

Once the film has partially dried to a flexible condition, it should be contacted with a substrate and separated from the aqueous bath. These steps may be accomplished sequentially or simultaneously.

Most simply and conveniently, the substrate surface to be coated is first submerged in the bath at an angle to the film. By simultaneously lifting the substrate and moving it laterally through the aqueous bath, the film adheres to the substrate and is separated from the bath, all in one motion.

In most instances, it is desirable that the substrate surface be evenly and completely coated with the film. With this in mind, the foregoing or other mechanical means of contacting the film and substrate surface to be coated may be adapted to ensure this further objective.

After separation from the bath, the laminate of substrate and adherent film is completely dried. Often this step is performed by simply allowing the carrier to complete evaporating at ambient temperature. If desired, however, elevated temperatures may be employed to accelerate evaporation and ensure permanent adhesion to the substrate.

In a particularly preferred embodiment, the final drying step is not accomplished immediately after separating the laminate from the bath. In this embodiment, the substrate employed for separation is not the substrate of the intended, final laminate. Instead, a flexible carrier sheet of, for example, a plastic such as polyethylene or cellophane is employed as a temporary substrate to which the film will releasably adhere. This provides a means for transferring the film to the final or permanent substrate for which the film is intended.

When the final substrate is available, the film-side of the carrier laminate is contacted with it. The film adheres to the final substrate and the carrier sheet may be separated, as by physically peeling it off the final laminate. In this manner, a substrate which cannot conveniently be coated when the film is removed from the bath may still receive a decorative coating.

Incident this final application, or similar steps as previously described, it may be desirable to enhance the adhesion obtained between film and final substrate. Accordingly, the substrate or the film may be coated with an adhesive material such as a varnish or all purpose adhesive. This ensures a tight and permanent bond between the final laminate layers.

Conversely, in employing a carrier sheet in accordance with the present invention, it may be desired to ensure against permanent adhesion. Thus, if the carrier sheet would otherwise tightly adhere to the film, it may first be coated with a conventional release agent. This coating insures against the formation of a permanent, integral lamination between film and carrier sheet. This will facilitate storage of the carrier laminate and eventual transfer of the film to the final substrate.

Where the carrier laminate has been stored, the film side may first be lightly coated with an organic solvent. Thus it may be misted or lightly wiped with solvent to ensure formation of an integral, final laminate.

In another preferred embodiment of this invention, the carrier sheet utilized is a sponge, preferably a sponge composed of polyurethane. Upon separation of the film from the bath, it can be retained on the sponge for a period of time. Alternatively, the film may be almost immediately transferred to the desired substrate.

One way in which such a carrier sponge sheet can be utilized involves providing the sponge as a coating on a drum which can be partially immersed in the bath. By revolving the drum, the film coats onto the surface of the drum side which rises from the bath. Suitable substrates can then be contacted with the film thus separated from the bath for an essentially simultaneous transfer to the substrate. This embodiment has the additional advantage of permitting essentially continuous application of the film to the eventual substrate because, while the transfer is taking place, additional film can be produced where the bath medium is caused to flow toward the drum.

The substrates utilized in forming the final laminate may vary widely in material and form as recognized in the art. They may be flexible materials such as paper, fabric or the like. They may also be rigid and comprise, for example, planks or moldings, usually composed of wood. In addition, however, they may have intricate shapes such as the arms, legs or other parts of furniture. They may even represent an entire wall. The advantages of the present invention permit application of a decorative film to any such forms.

The foregoing is illustrative of the present invention. The scope of this invention is indicated by the appended claims, and all changes which come within the meaning and range of equivalence of these claims are intended to be embraced therein.

What is claimed is:

1. A method for the production of a laminate comprising a decorative film on a substrate, said method comprising:

A. providing an aqueous bath;

B. applying a relatively minor amount of a lacquer colorant to the surface of said bath;

C. partially drying said colorant to produce a flexible film;

D. causing a surface of a first substrate to contact and releasably adhere to a surface of said film;

E. separating the resultant, temporary laminate from said aqueous bath; and

F. contacting and fixedly adhering said partially-dried film to a surface of a second substrate to produce a final laminate.

2. The method of claim 1, wherein the second substrate surface has a coating of adhesive material.

3. The method of claim 1, wherein the film is patterned prior to contact with the first substrate.

4. The method of claim 3, wherein the patterning is performed by mechanical agitation of the lacquer on the bath surface.

5. A method of claim 4, wherein a solvent is sprayed onto the film of colorant before mechanical agitation.

6. The method of claim 1, wherein the film is dried on the second substrate.

7. The method of claim 6, wherein the bath flows past the area of application of lacquer colorant and film is separated at a distant, downstream area of the bath surface, thereby permitting continuous production of film.

8. The method of claim 7, wherein the partially-dried colorant film is releasably attached to the first substrate comprising a flexible carrier sheet.

9. The method of claim 8, wherein the carrier sheet is a sponge from which the film is essentially simultaneously transferred to the second substrate.

10. The method of claim 1, wherein partially-dried, colorant film is releasably attached to the first substrate comprising a flexible carrier sheet.

11. The method of claim 10, wherein the carrier sheet is released from the colorant film and the film is dried on the second substrate.

12. The method of claim 11, wherein the carrier sheet is a sponge from which the film is essentially simultaneously transferred to the second substrate.

* * * * *